US008491421B1

(12) United States Patent
Scott

(10) Patent No.: US 8,491,421 B1
(45) Date of Patent: Jul. 23, 2013

(54) HANDHELD DEVICE AND METHOD FOR ESTIMATING THE EFFECTIVE DISTANCE OF A GOLF SHOT ON SLOPED TERRAIN

(76) Inventor: Mark T. Scott, Thornton, CO (US)

( * ) Notice: Subject to any disclaimer, the term of this patent is extended or adjusted under 35 U.S.C. 154(b) by 85 days.

(21) Appl. No.: 13/155,539

(22) Filed: Jun. 8, 2011

Related U.S. Application Data

(60) Provisional application No. 61/353,159, filed on Jun. 9, 2010, provisional application No. 61/415,062, filed on Nov. 18, 2010, provisional application No. 61/444,683, filed on Feb. 18, 2011.

(51) Int. Cl.
*A63B 57/00* (2006.01)

(52) U.S. Cl.
USPC ..... 473/404; 33/385

(58) Field of Classification Search
USPC ..... 473/404; 33/385
See application file for complete search history.

(56) References Cited

U.S. PATENT DOCUMENTS

| | | | | | |
|---|---|---|---|---|---|
| 4,260,151 | A | | 4/1981 | Weaver | |
| 4,717,251 | A | * | 1/1988 | Wells et al. | 356/4.08 |
| 5,157,842 | A | | 10/1992 | Swanda | |
| 5,159,401 | A | * | 10/1992 | Decker, Jr. | 356/140 |
| 5,398,422 | A | | 3/1995 | Clarkson | |
| 5,476,258 | A | | 12/1995 | Frisone | |
| 5,528,518 | A | * | 6/1996 | Bradshaw et al. | 702/150 |
| 5,662,535 | A | | 9/1997 | Smith | |
| 5,671,160 | A | * | 9/1997 | Julian | 702/94 |
| 5,792,015 | A | | 8/1998 | Hoyt et al. | |
| 5,859,693 | A | * | 1/1999 | Dunne et al. | 356/4.01 |
| 6,059,672 | A | * | 5/2000 | Zeiner-Gundersen | 473/407 |
| 6,873,406 | B1 | * | 3/2005 | Hines et al. | 356/141.1 |
| 7,239,377 | B2 | | 7/2007 | Vermillion | |
| 7,288,032 | B2 | | 10/2007 | Chabala | |
| 7,535,553 | B2 | * | 5/2009 | Vermillion et al. | 356/4.01 |
| 2006/0073916 | A1 | | 4/2006 | Lin | |

* cited by examiner

*Primary Examiner* — Vishu K. Mendiratta
(74) *Attorney, Agent, or Firm* — Brian D. Smith, P.C.

(57) ABSTRACT

A handheld device for golfers is disclosed which determines the slope from a golf ball's location on the golf course to the cup or pin on a green. The device includes: a housing; a sight mounted on the housing for aiming the device at the flag of the pin; a tilt sensor for measuring the slope or tilt of the aimed device; a display wheel cooperating with the tilt sensor for indicating the slope or tilt of the aimed device; and, a chart affixed to the housing including actual ball to cup distances, slope indications and yardage adjustments which are added to or subtracted from the actual distances to enable the golfer to estimate the effective shot distance of the ball to the cup. A software application is also disclosed for estimating the effective shot distance of a golf ball to a target on a handheld device such as a smart phone.

5 Claims, 11 Drawing Sheets

HANDHELD DEVICE AND METHOD FOR ESTIMATING THE EFFECTIVE DISTANCE OF A GOLF SHOT ON SLOPED TERRAIN

CROSS REFERENCE TO RELATED APPLICATIONS

This application is a nonprovisional application claiming the benefit under 35 USC 119(e) of U.S. provisional application Ser. No. 61/353,159 filed on Jun. 9, 2010, U.S. provisional application Ser. No. 61/415,062 filed on Nov. 18, 2010 and U.S. provisional application Ser. No. 61/444,683 filed on Feb. 18, 2011 which are incorporated herein by reference.

BACKGROUND OF THE INVENTION

1. Field of the Invention

The present invention generally relates to devices and methods for measuring slope to a target and more specifically to devices and methods for measuring the slope from a golf ball's location on the golf course to the pin or other desired target and selecting a golf club based upon the measured slope.

2. Description of the Related Art

As discussed generally in U.S. Pat. No. 7,239,377 to Vermillion, it is often desirable to determine the distance to a target in various situations. For example, golfers like to know what the distance of their ball is from the green, or a pin positioned on the green, to help them decide what club to select and to decide how hard or forcefully to swing the club. Most golf course fairways are provided with distance markers which provide the golfer with a general idea what the distance to the pin is. However, these conventional markers only provide straight-line distances to the pin and fail to account for the uphill or downhill slope of the golf course to the pin or as discussed in Vermillion the parabolic trajectory of projectiles. As a result, while conventional markers work well on a relatively flat course their usefulness is quite suspect on golf courses with substantial uphill and downhill grades.

The Vermillion patent provides an electronic device which addresses this problem. This electronic device includes a laser range sensor for determining a first range to the target; a tilt sensor for determining an angle to the target relative to the device based on the orientation of the device; a computing element, coupled with the distance sensor and the tilt sensor, for determining a second range by multiplying the first range by a factor corresponding to the determined angle and adding the result to the first range, the second range being a representation of a flat-ground distance the projectile must travel such that the projectile's trajectory intersects the target; and a display, coupled with the computing element, for indicating the first range and the second range.

While Vermillion's electronic device addresses the problem it utilizes electronic components which are somewhat expensive and easily destroyed if the device is accidentally dropped or exposed to the elements as can easily happen on the golf course if it begins raining Lightning which also often occurs on a golf course may also damage or destroy the device's electronics. Vermillion's laser range sensor for determining a first range to the target (i.e. the "straight line distance" to the pin) is also largely unnecessary since most golf courses include distance markers on the fairway which provide the golfer with the actual straight line distance to the pin.

SUMMARY OF THE INVENTION

The present invention addresses the aforementioned problems by providing a handheld device for use by golfers to determine the slope or inclination from a golf ball's location on the golf course to the cup on a green. The device further provides the golfer with the ability to use this information to estimate the effective shot distance of the ball to the cup when the golfer knows the actual distance of the ball to the cup. The actual distance sometimes referred to as straight line distance to the cup is readily available on most golf courses today which have distance markers located on the fairway or GPS units in their golf carts.

The handheld device of the present invention includes: a housing; a sight mounted on the housing for aiming the device; a tilt sensor for measuring the slope or tilt of the aimed device; a display wheel cooperating with the tilt sensor for indicating the slope or tilt of the aimed device to a golfer using the device; and, a chart affixed to the housing including actual ball to cup distances (yardage to target), slope indications and yardage adjustments which are added to or subtracted from the actual distances to enable the golfer to estimate the effective shot distance of the ball to the cup taking the slope of the ball to the cup into consideration.

In addition, the present invention provides a method for estimating the effective shot distance of a golf ball to the cup which uses the device of the present invention which takes the slope of the ball to the cup or other desired target into consideration. The method includes providing the handheld device of the present invention as described above; determining the actual "straight line" distance of a golf ball from its location on a golf course to a desired target; aiming the device at the target from the golf ball's location; viewing the slope indicated by the device when it is aimed at the target; and, using the chart of the handheld device to find the distance or yardage adjustment to be added to or subtracted from the actual distance of the golf ball to the cup based upon the slope indicated by the device. The method thereby provides the golfer with an easy to use way of estimating the effective shot distance of the ball to the target or cup which takes the uphill or downhill slope of the ball to the cup or other target into consideration.

In addition, the present invention may be implemented on smart phones such as the Apple I Phone with what is euphemistically referred to today as a smart phone "app". The smart phone "app" or application will provide an estimated "play-as" or effective distance of the shot when the golfer encounters an elevation change that will influence the effective carry distance of the golf ball while playing the approach shot to the green/pin. This smart phone application will incorporate four major features, which are:

1. A rear facing camera on the smart phone to create a live view of the green/pin.
2. A live view screen on the smart phone to accurately target the green/pin.
3. A 3 axis accelerometer built into the smart phone to obtain accurate slope readings.
4. A database of distance correction factors based on slope and distance.

In its broadest sense, the smart phone or handheld software app or application of the present invention provides a method for estimating the effective shot distance of a golf ball to a target on a handheld device of the type having a computer, an electronic display, memory for storage of information, a sight for aiming the device at a target, an accelerometer for measuring the slope of the aimed device and means for entering information into said computer and memory. As indicated, most smart phones and many wifi handheld devices which are actually handheld computers such as Apple's i Pod Touch have these features.

The method which is carried out by the software app on these devices begins with the step of installing the app on a handheld device or computer as discussed above. The app or software preferably includes a database of distance adjustments based upon the slope of a golf ball to a target and the actual distance of the golf ball to the target. The software additionally provides instructions which allow a user to save slope (measured by the device's accelerometer) to the device's memory. The software further includes instructions which allow the user to enter the actual distance of a golf ball to a desired target into memory and when actual distance is entered into memory by the golfer/user, the software preferably instructs the computer to access the database of distance adjustments and calculate the effective shot distance of the ball to the target. The software does this by adjusting the entered actual distance of the ball to the target by a distance adjustment selected from the database, the selection of which is based upon saved measured slope and entered actual distance.

After downloading and installing the app software as discussed, the golfer/use carrying out the method aims the device at a desired target from the golf ball's location using the device's sight so that the device's accelerometer measures the slope of the aimed device from the ball's location to the target. The measured slope is then saved to memory preferably by pressing a save or capture button on the handheld device. The golfer/user carrying out the inventive method then determines the actual distance of the golf ball to the desired target (which may be determined from the yardage markers on the cours) and enters the actual distance into the device's memory. The golfer/user will typically enter this distance using the device's keyboard which may be a manual keyboard or a virtual touch screen type keyboard that simply appears on the device's electronic display. Whatever the input means, when the actual distance is entered the software instructs the computer to access the database of distance adjustments and calculate the effective shot distance of the ball to the target. As mentioned above, the software does this by adjusting the entered actual distance of the ball to the target with distance adjustment selected from the database, the selection of which is based upon saved measured slope and entered actual distance.

In a preferred embodiment, after launching the software app, the app will prompt the golfer to select the desired units of distance, i.e. yards or meters. The golfer will make the selection which will then be automatically saved to memory but which can be changed by the golfer if desired by simply returning to the page of the app offering the selection and then changing the selection.

Other aspects and advantages of the present invention will be apparent from the following detailed description of the preferred embodiments and the accompanying drawing figures.

BRIEF DESCRIPTION OF THE DRAWING FIGURES

A preferred embodiment of the present invention is described in detail below with reference to the attached drawing figures, wherein.

Figure 16:
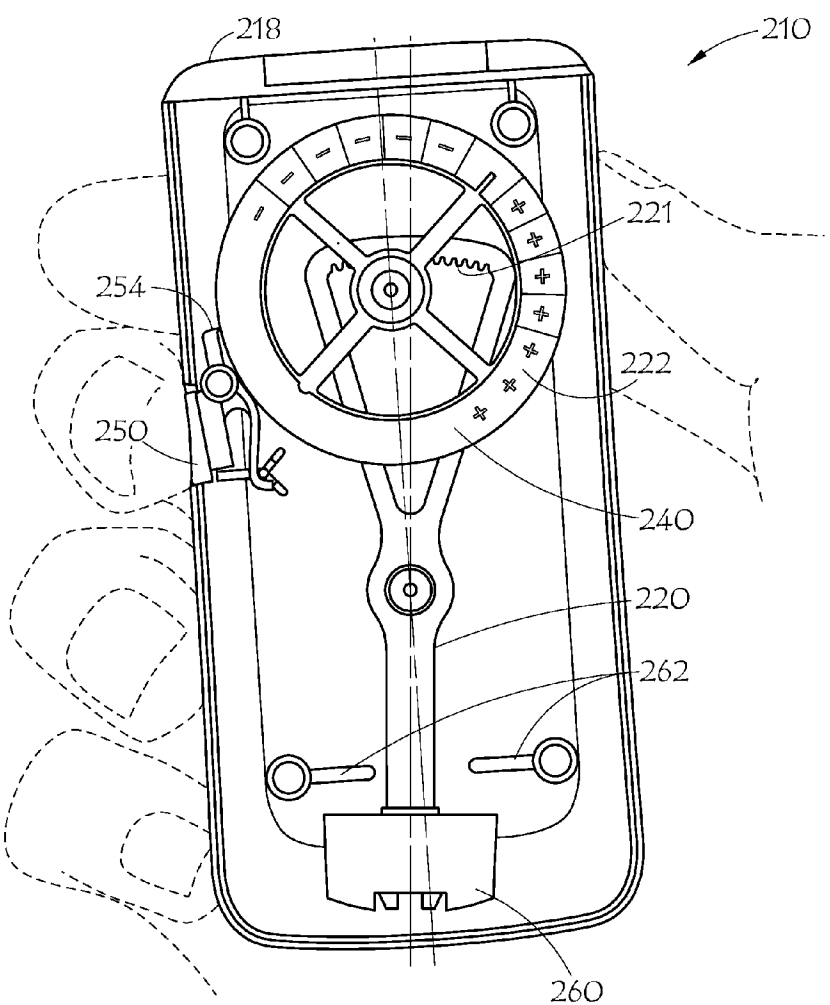
Figure 15:
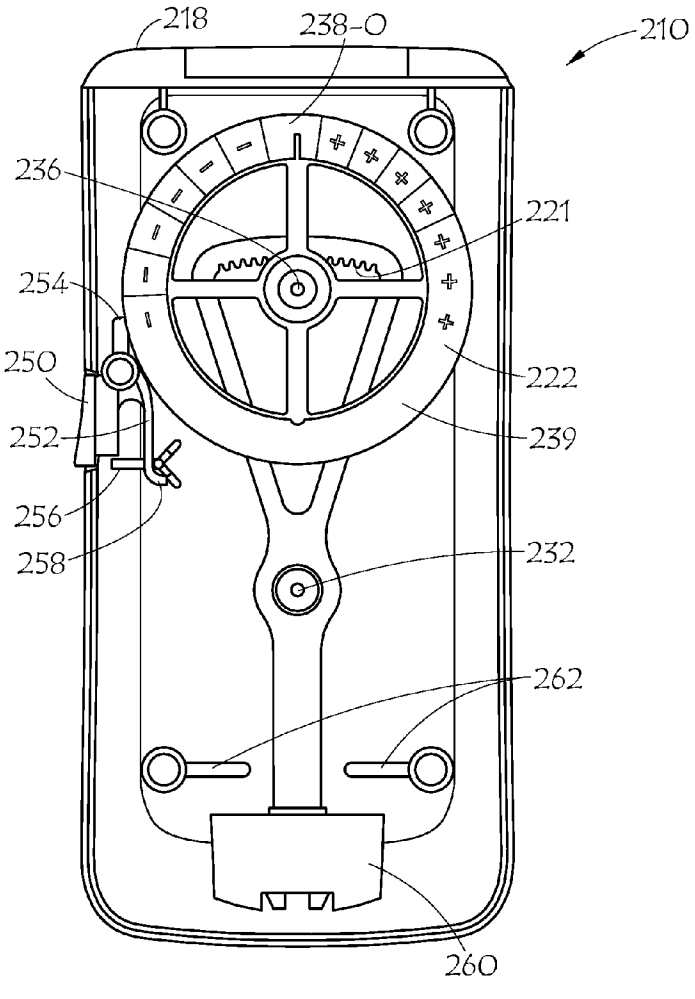
FIG. 15 is a cross sectional view taken along lines 15-15 of FIG. 13.
Figure 17:
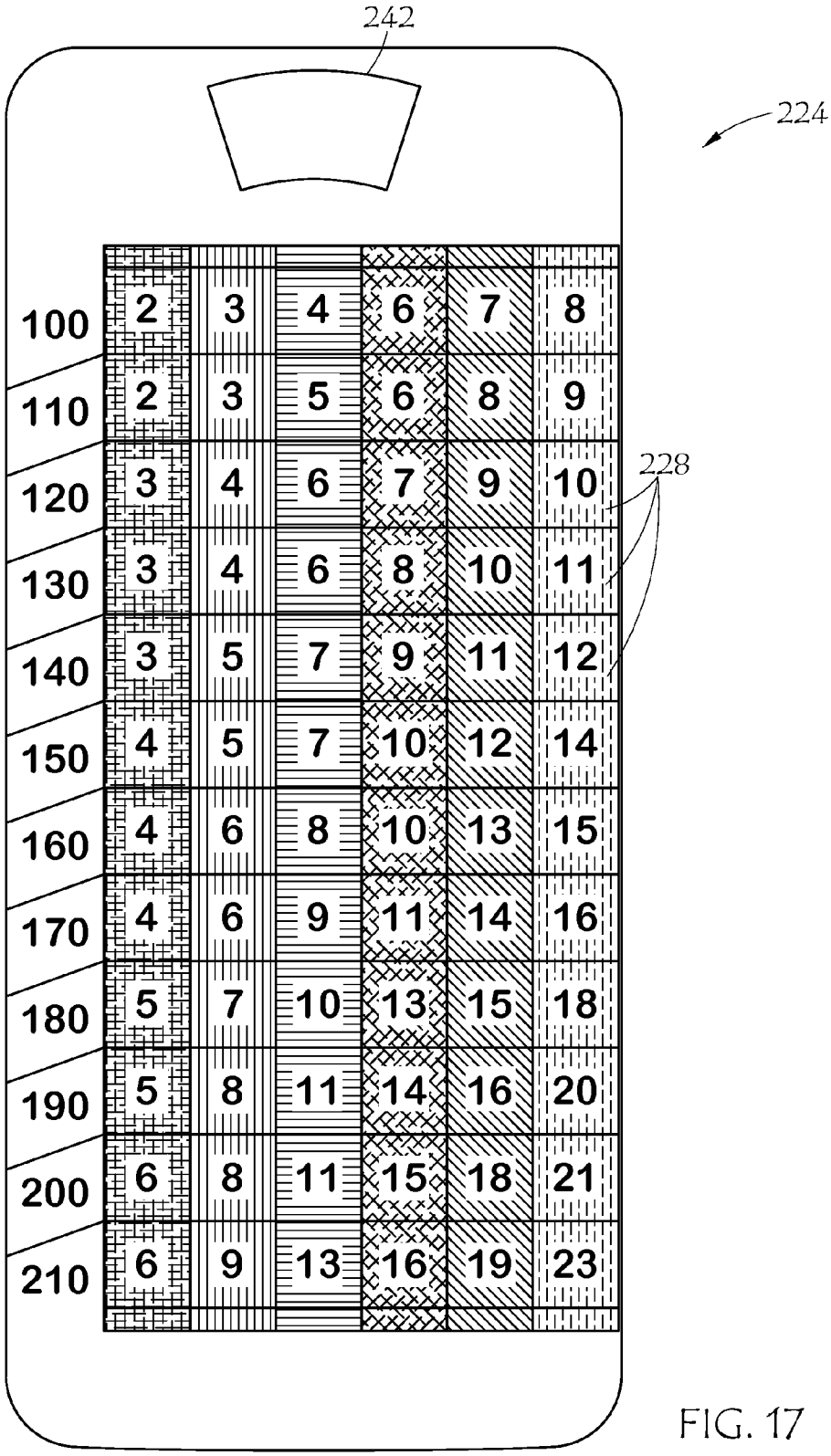

FIG. 16 is a cross sectional view similar to that of FIG. 15 which additionally shows the device being held in an individual's hand shown in phantom. As shown, button 250 of the device is being depressed by a finger of the hand and the device is also shown tilted slightly as it can appear when being aimed at a target; and, FIG. 17 is a side elevational view showing in isolation the chart which is for use with and attachment to the side of the device of FIG. 13.

The drawing figures do not limit the present invention to the specific embodiment disclosed and described herein. The drawings are not necessarily to scale, emphasis instead being placed upon clearly illustrating the principles of the invention.

DETAILED DESCRIPTION OF THE PREFERRED EMBODIMENTS

Figure 3:
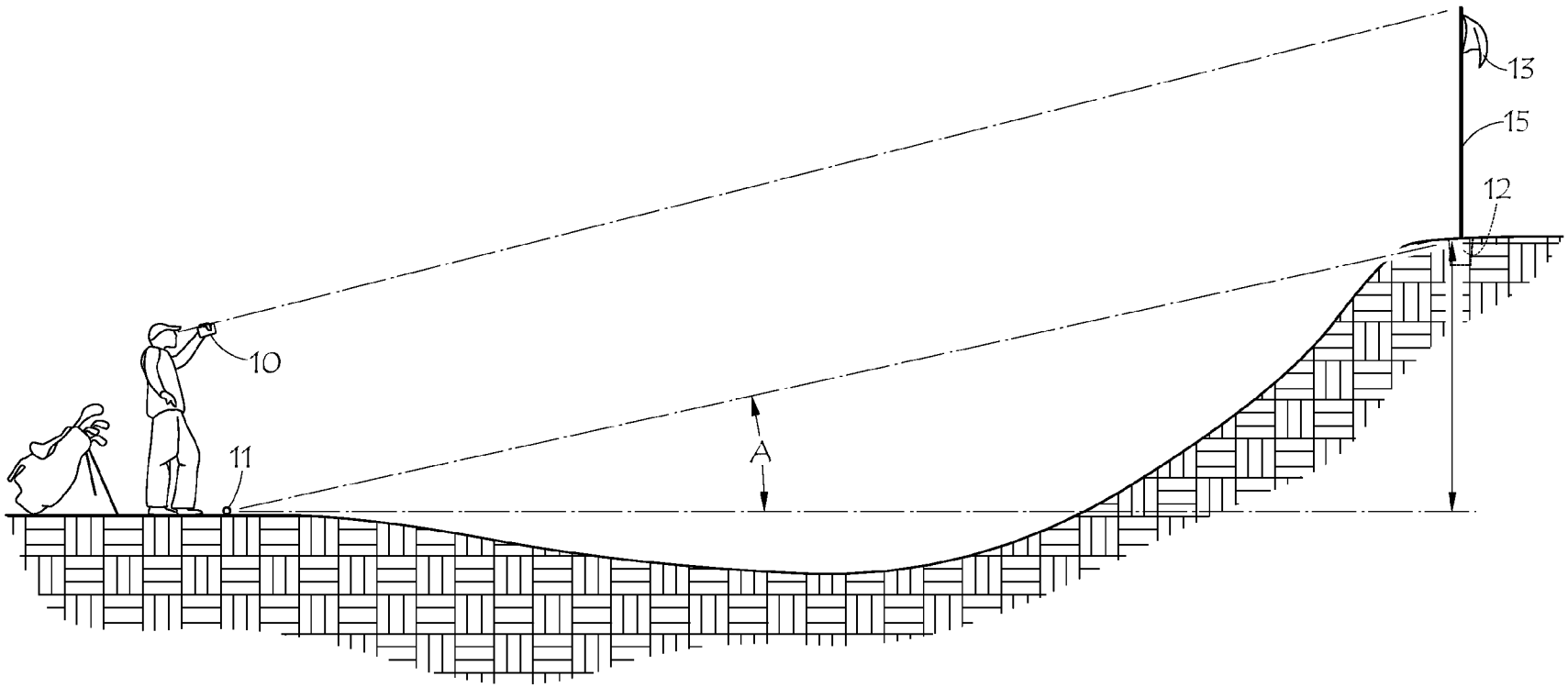
FIG. 3 is a side elevational view showing a golfer using the device to determine slope A from his ball's position on a golf course to the cup on the green.

FIGS. 1-5 illustrates a preferred embodiment of the present invention which includes a handheld device 10 (also referred to as a handheld estimator herein) for use by golfers to measure the slope as indicated by angle A in FIG. 3 from a golf ball 11's location on a golf course to the cup 12 on a green (or any other target a golfer is trying to reach). The device further provides the golfer with the ability to use this information to estimate the effective shot distance of the ball to the cup when the golfer knows the actual distance of the ball to the cup or target.

As illustrated in FIGS. 1, 2, 4 and 5, device or estimator 10 broadly includes: a housing 14, a sight including a front sight 16 and a pair of spaced rear sights 17 mounted on the top surface 18 of the housing a tilt sensor 20 for measuring the slope or horizontal angle of the aimed device, a display wheel 22 cooperating with the tilt sensor for indicating the slope to the golfer using the device, and, a chart 24 affixed to a side surface 26 of the housing including actual ball to cup distances (yardage to target), slope indications (colored columns of squares 28) and yardage adjustments in each square 28 from which the effective shot distance of the ball to the cup can be estimated.

The device is easily aimed at a target typically the flag 13 of the pin 15 on the green of a golf course as shown in FIG. 3 by simply aiming the device so that the target appears directly behind sights 14 and 16 when sights 14 and 16 are aligned in the conventional way with front sight 14 positioned between the pair of rear sights 16.

Figure 1:
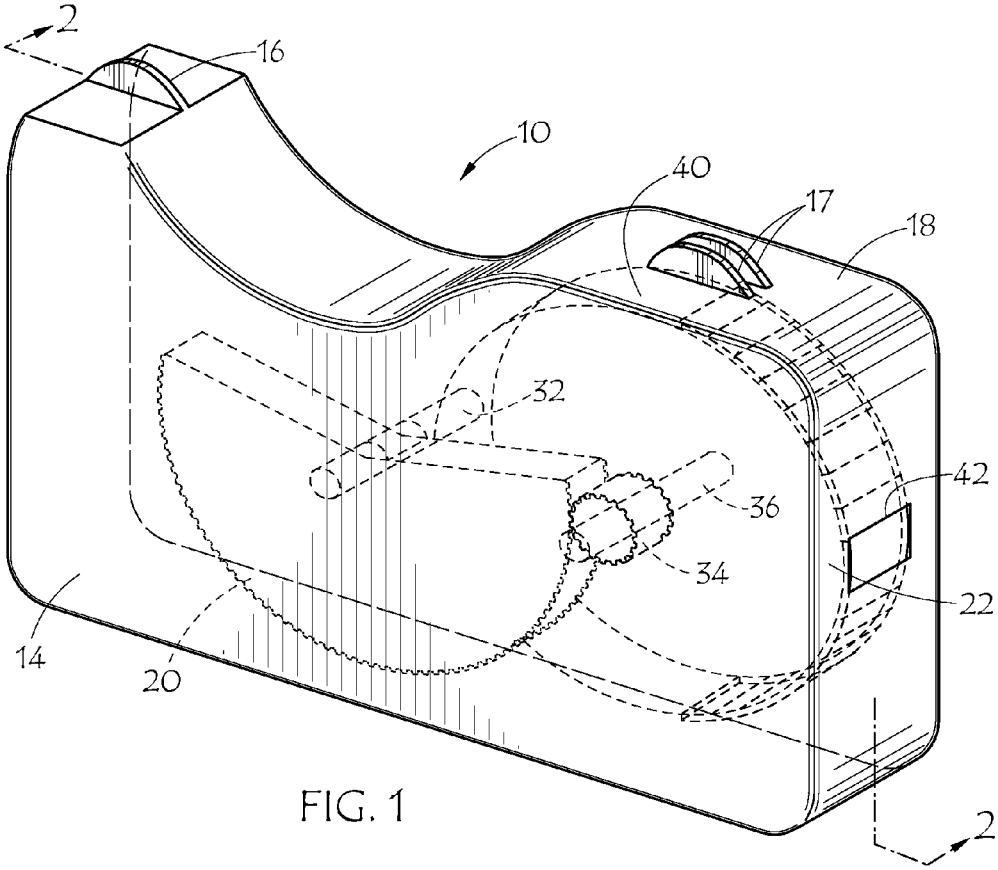
FIG. 1 is a perspective view of the device of the present invention showing the internal components of the device in phantom.
Figure 2:
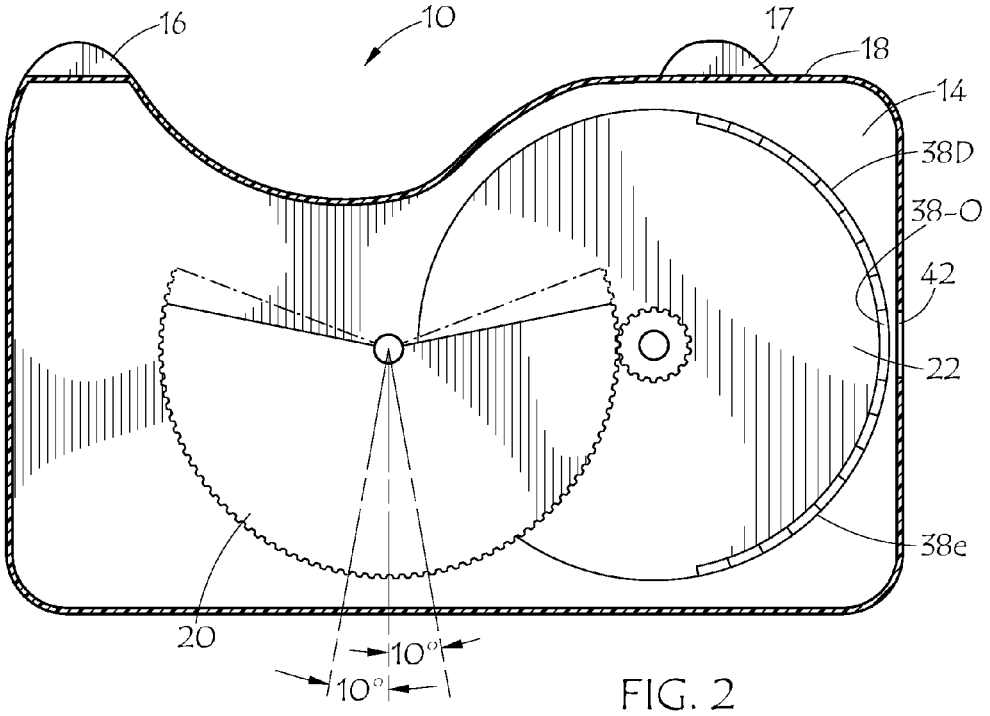
FIG. 2 is a cross sectional view of the device of FIG. 1 taken along lines 2-2 of FIG. 1.
Figure 4:
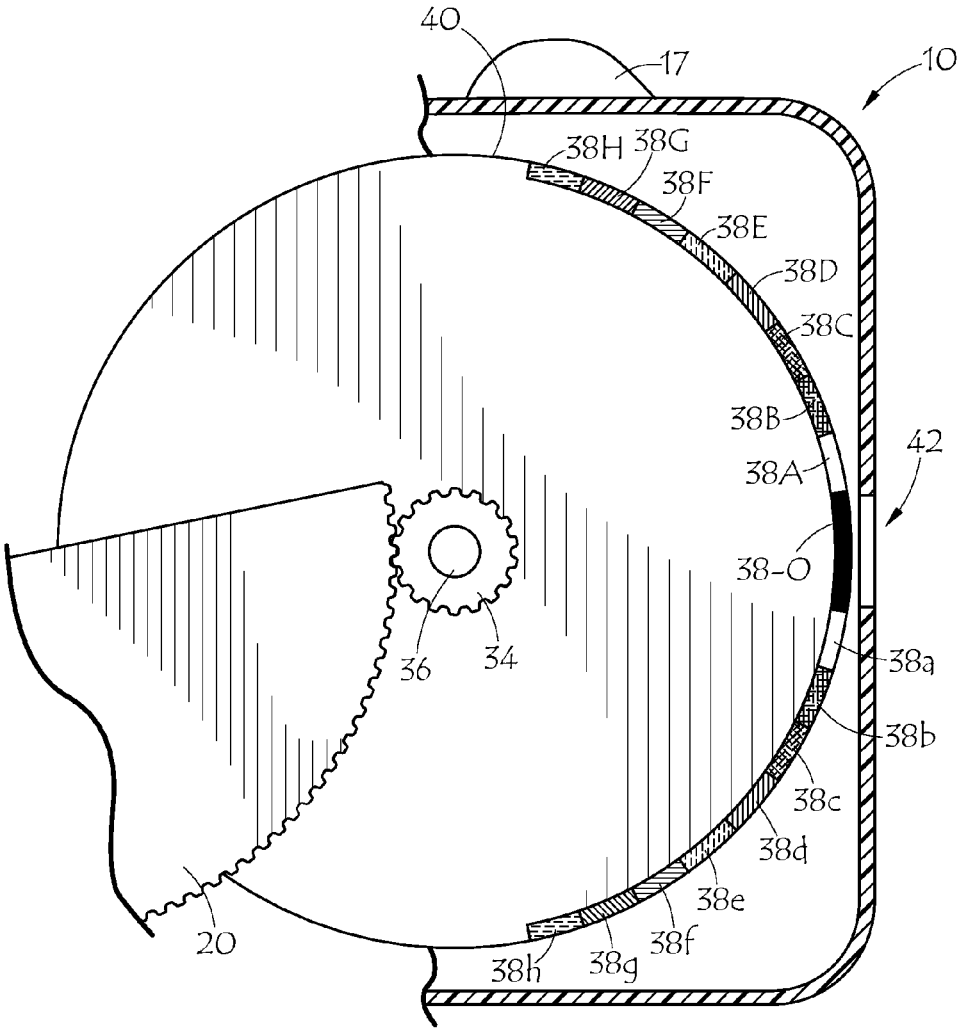
FIG. 4 is a partial but enlarged view similar to the view shown in FIG. 2.

Returning to FIGS. 1, 2, 4 and 5, it will be appreciated that tilt sensor 20 is a weighted large diameter gear also referred to herein as first gear 20 which rotates about an axle 32 mounted in housing 14. As will be appreciated perhaps best from FIG. 2, the weighted gear rotates about axle 32 in response to changes in the slope or tilt of the aimed device. The figures further illustrate that display wheel 22 is engaged by first gear 20 via a small second gear 34 which is fixedly attached to display wheel 22 and axially aligned therewith about an axle 36. Axle 36 similar to axle 32 is also mounted in housing 14. As will be appreciated, rotation of first gear 20 in response to changes in the slope/tilt of the aimed device will cause wheel 22 to rotate as well. However, because the gear ratio between the first gear and the second is preferably about 8:1, display wheel 22 will actually rotate through a much greater axial distance than first gear 20. For example, a 10 degree rotation of the first gear will produce an 80 degree rotation of the display wheel if the gear ratio between the first and second gears is 8:1. This greater rotation of the display wheel allows colored sections 38A-H and 38*a-h* to be printed or affixed to the outer peripheral edge 40 of the wheel as shown in FIGS. 1 and 4. These sections are provided with different colors and are also sized and calibrated so that each colored section indicates or corresponds to a different slope or tilt of the aimed device when the colored section is viewed through a viewport 42 of the device's housing 14. The viewport is sized and positioned in the housing so that a golfer looking into the viewport will see the color section of the color wheel which corresponds to and thus indicates the slope of the aimed device. For example, section 38A is sized and positioned on the wheel so that when the device is tilted upwardly about 1.25 degrees from horizontal section 38A will align with the viewport so that it can be seen by a golfer looking into the viewport. Similarly, when the device is tilted downwardly 1.25 degrees color section 38*a* will appear in the viewport. The color for sections 38A and 38*a* is the same but the golfer should be able to determine whether the slope is uphill or downhill simply by looking at the green from his location on the course. Section 38-0 of the color wheel which lies between sections 38A and 38*a* indicates no slope to the green, i.e. 0 degrees. The next sections on the wheel, i.e. 38B and 38*b*, respectively indicate a 2.5 degree uphill and downhill slope. Again, sections 38B and 38*b* preferably share the same color but this color is different than that of 38A and 38*a*. The following table sets forth the tilt/slope for each color section of the wheel as well as a preferred color for each slope.

| Section | Color | Slope/tilt |
|---|---|---|
| 38-0 | Black | 0.0° |
| 38A-a | White | 1.25° |
| 38B-b | Yellow | 2.5° |
| 38C-c | Orange | 3.75° |
| 38D-d | Red | 5.0° |
| 38D-e | Purple | 6.25° |
| 38F-f | Blue | 7.5° |
| 38G-g | Green | 8.75° |
| 38H-h | Grey | 10.0° |

Figure 5:
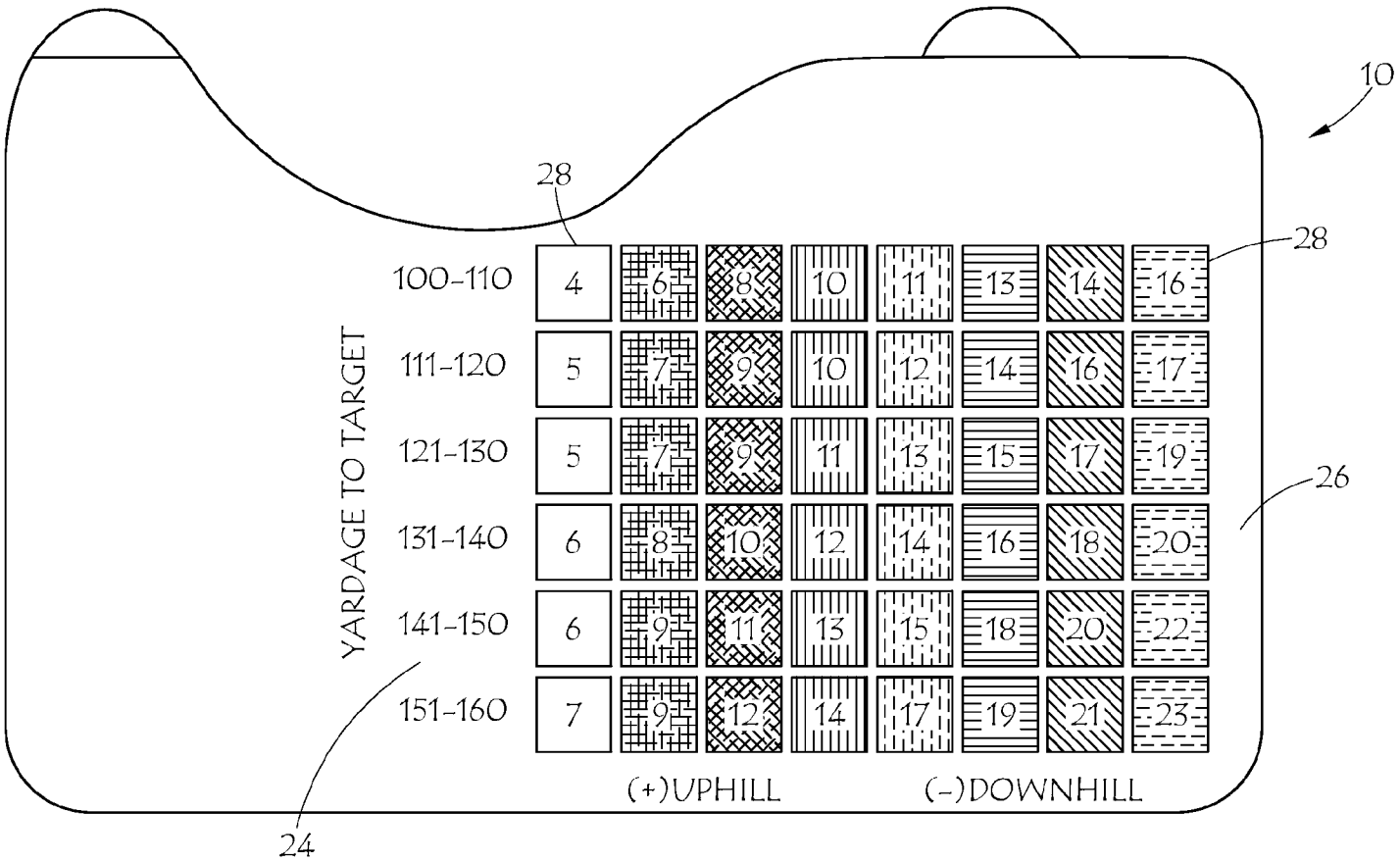
FIG. 5 is a side elevational view of the device of FIG. 1 showing the chart affixed to the side of the device.

FIG. 5 illustrates chart 24 which is affixed to side 26 of the housing. Chart 24 is provided along its left side with six yardage to target measurements. This yardage is the actual distance of the ball to the target, i.e. the pin or cup on the green, which is sometimes referred to as the "straight line" or horizontal distance to the pin and this is information which the golfer can easily obtain on most golf courses since most if not all golf courses today are provided with yardage distance markers to the pin on the fairway or GPS units in the golf carts.

Chart 24 also includes eight differently colored columns of squares 28, each of which has a number in the square which is a distance adjustment, typically in yards or meters, to be made to the actual distance of the ball to the cup to compensate for the slope of the course from the ball to the cup. The colors in the squares correspond to the color seen by the golfer in the viewport when aiming the device at the pin and the yardage adjustment in each square 28 indicates the yardage which the golfer will either add or subtract from the actual distance of his ball to the pin depending on whether the slope to the pin is uphill or downhill. Accordingly, if the golfer knows the actual distance or straight line distance of the ball to the pin (cup) is 100 yards and if the color red appears in the viewport when he aims the device at the pin and he further knows that the slope to the pin is uphill, when he looks at chart 24 on the side of the device he will see that the number 10 indicating 10 yards is printed in the red square in the row marked 100-110 which is the row for actual distance to the pin. Therefore, the golfer knowing his actual distance is 100 yards to the pin will add 10 yards to the 100 yards of actual distance to come up with an effective distance to the pin of 110 yards. The addition of 10 yards to the shot thereby takes into consideration the 5 degree uphill slope of the shot to the pin. This information is useful to the golfer in club selection and in deciding how hard to swing the club.

In addition and as previously indicated, if the slope were downhill and the color red appeared in the viewport this would indicate to the golfer to subtract 10 yards from his actual distance to the pin of 100 yards so that the effective distance of the shot to the pin would be 90 yards. While not shown in the drawings, the other side of the device would also preferably include a chart similar to chart 24 but would be for actual distances that are farther away from the pin, e.g. from 160 yards to 200 yards or more. In addition, the yardage adjustments shown in chart 24 are best guess estimates and it should be understood that variables such as wind, temperature, humidity and elevation will also affect the effective shot distance.

In view of the above, it will be appreciated that the present invention provides a method for estimating the effective shot distance of a golf ball to the cup which uses the device of the present invention which takes the slope of the ball to the cup into consideration. The method includes providing the handheld device of the present invention as described above; determining the actual "straight line" distance of a golf ball from its location on a golf course to the cup on a green of the golf course; aiming the device from the golf ball's location on a golf course at the flag of a pin located in the cup on a green of the golf course; viewing the slope indicated or measured by the device when it is aimed at the flag of the pin; and, using the chart of the handheld device to find the yardage adjustment to be added to or subtracted from the actual distance of the golf ball to the cup based upon the slope indicated by the device. The method thereby provides the golfer with an easy to use way of estimating the effective shot distance of the ball to the cup which takes the uphill or downhill slope of the ball to the cup into consideration.

In addition to the mechanical embodiment of FIGS. 1-5, FIGS. 6-12 set forth a computerized embodiment/system of the present invention which is preferably implemented on a mobile device such as the smart phone 100 shown in FIGS. 7-12 or a similar handheld device such as the I Pod Touch. The invention is preferably implemented on phone 100 by downloading and installing a software application for carrying out the methodology of the invention (referred to as an "App") onto phone 100. Apps for downloading and installing on mobile devices are commonly available online from online stores such as Apple's I-Phone App Store. Apple's App store can be visited online at http://www.apple.com/iphone/apps-for-iphone/. The App for carrying out the instant invention is expected to be available online at Apple's App store and at other App stores such as App stores for Google's Android system and Microsoft's Windows Mobile App system.

Figure 6:
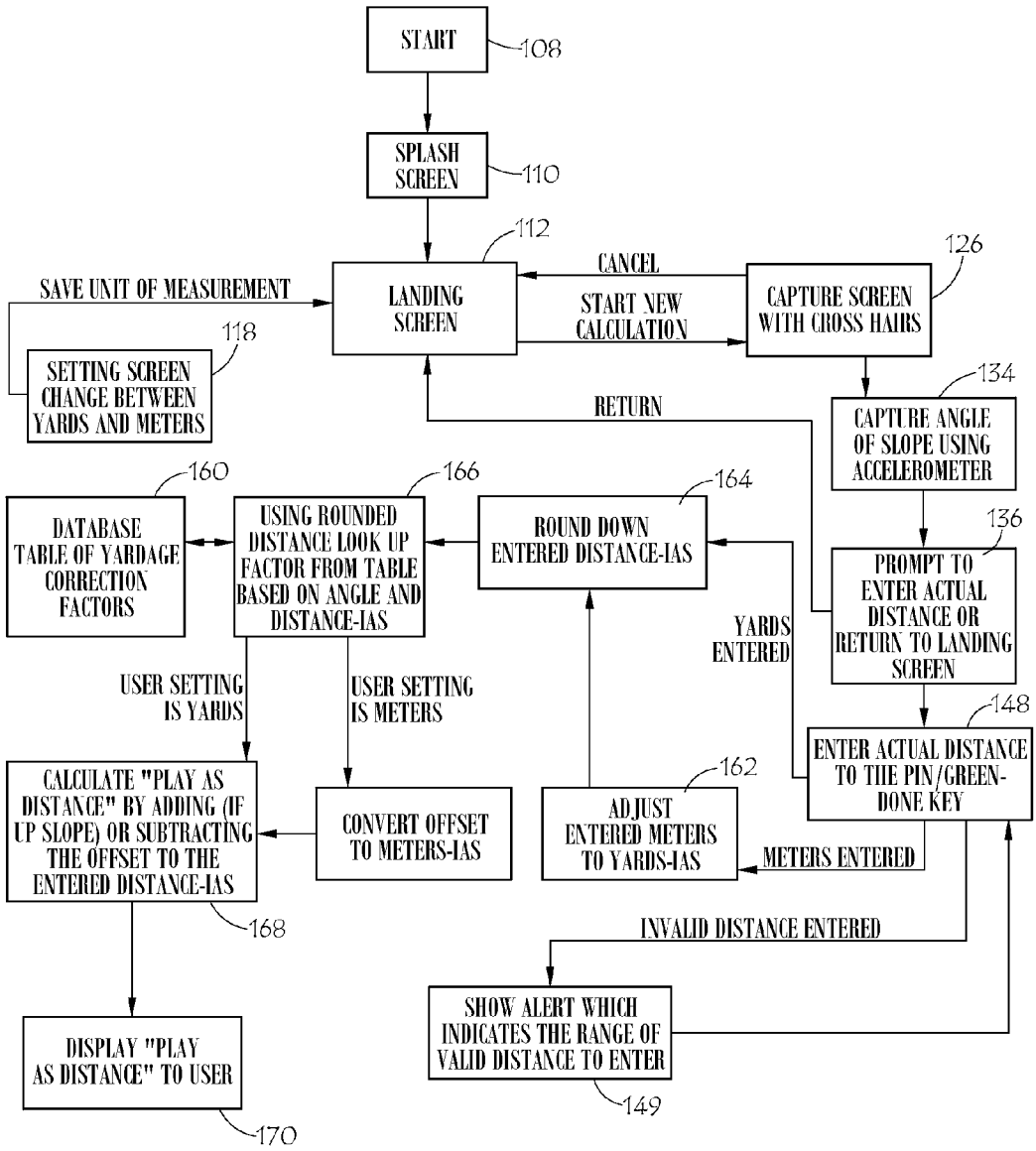
FIG. 6 is a flowchart of a method of the present invention for estimating the effective shot distance of a golf ball to a target which is carried out on a handheld computer such as a smart phone by a software application or app.

FIG. 6 sets forth a flow chart of the steps a golfer/user takes as well as the internal steps the App carries out on a user's smart phone 100 to determine "play as" distance to the pin using the computerized methodology of the present invention. After downloading and installing the App on the golfer/user's smart phone or other handheld device (or otherwise accessing the system), a golfer/user desiring to use the App activates or initiates the App on their mobile device 100 at 108 of FIG. 6 by clicking or tapping on the icon (not shown) for the App which preferably is placed or located on the device's main menu screen (not shown). The App may also be initiated in one of many other ways known to those skilled in the art but whatever means is used it should be intuitive and/or user friendly.

Figure 7:
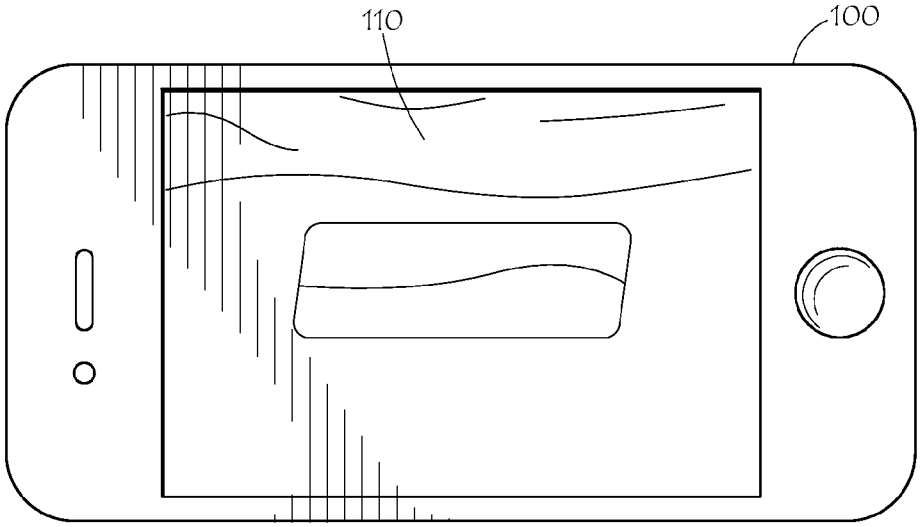
FIG. 7 is a front plan view of a handheld computer having an electronic display showing the loading screen referred to as the Splash screen of the software application for carrying out the method of FIG. 6.

In any event, as currently contemplated when the App is started the App's loading screen referred to as a Splash screen 110 as shown in FIG. 7 will appear on the device's screen (not numbered). The Splash screen also indicated at 110 in FIG. 6 indicates to the user that the APP is loading or starting up. When the App is finished loading, a screen 112 referred to as the landing screen or Calculate Play as Distance/Setting screen 112 (see FIG. 8) will automatically load and prompt the user to select either the Settings button 114 to select the desired units of measurement (yards or meters) or the Calculate Play As Distance button 116.

Figure 8:
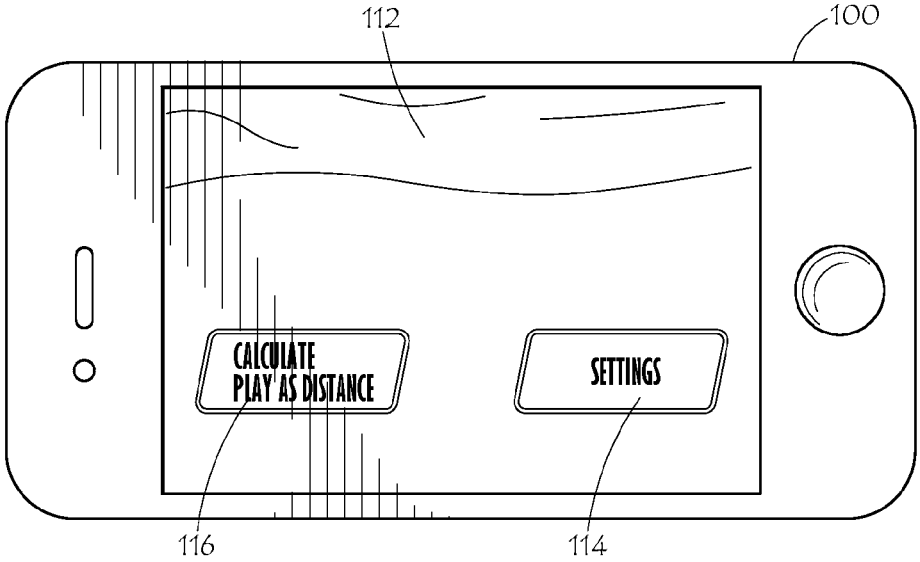
FIG. 8 is another front plan view of the handheld computer of FIG. 7 showing a screen referred to as the Landing screen of the software application for carrying out the method of FIG. 6.
Figure 9:
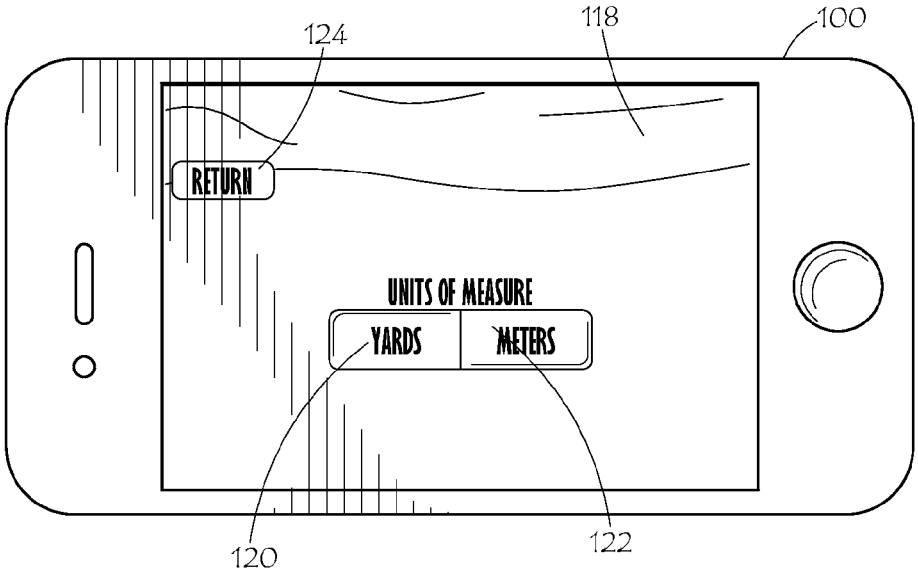
FIG. 9 is another front plan view of the handheld computer of FIG. 7 showing a screen referred to as the Settings screen which allows the user to select yards or meters as the unit of measurement for carrying out the method of FIG. 6.

If the user selects the Settings button 114 the APP will load the Settings screen 118 as shown in FIG. 9 (and at 118 in FIG. 6) which allows the user to select Yards 120 or Meters 122 as the unit of measurement. After selecting the desired units of measurement, the user then selects button 124 to return to the Calculate Play as Distance/Setting screen 112 shown in FIG. 8.

Figure 10:
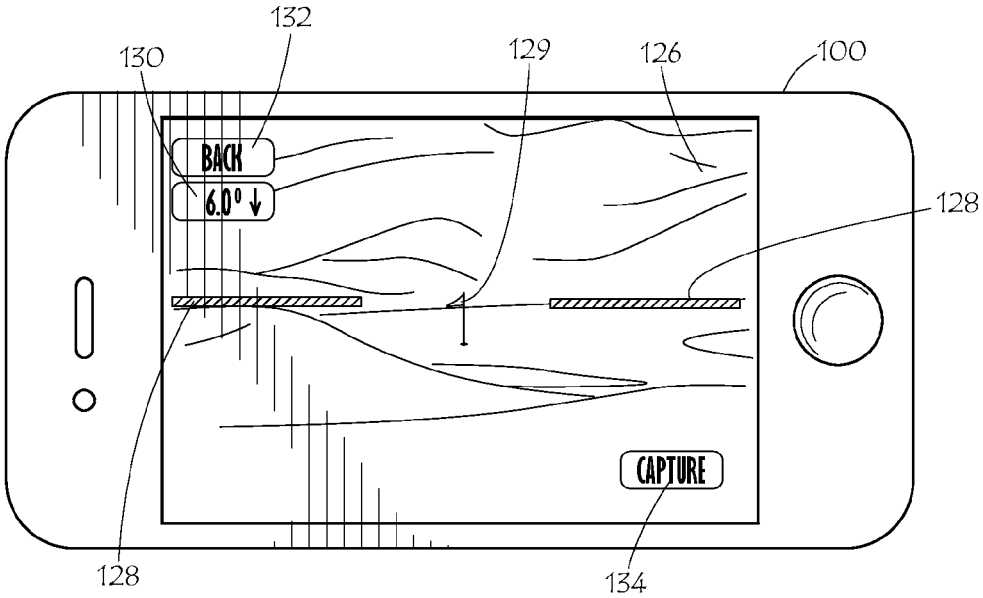
FIG. 10 is another front plan view of the handheld computer of FIG. 7 showing a screen referred to as the Capture screen. When this screen is displayed the software accesses the phone's accelerometer which is used to measure slope in accordance with the method of FIG. 6 when the handheld computer is aimed at a target.
Figure 11:
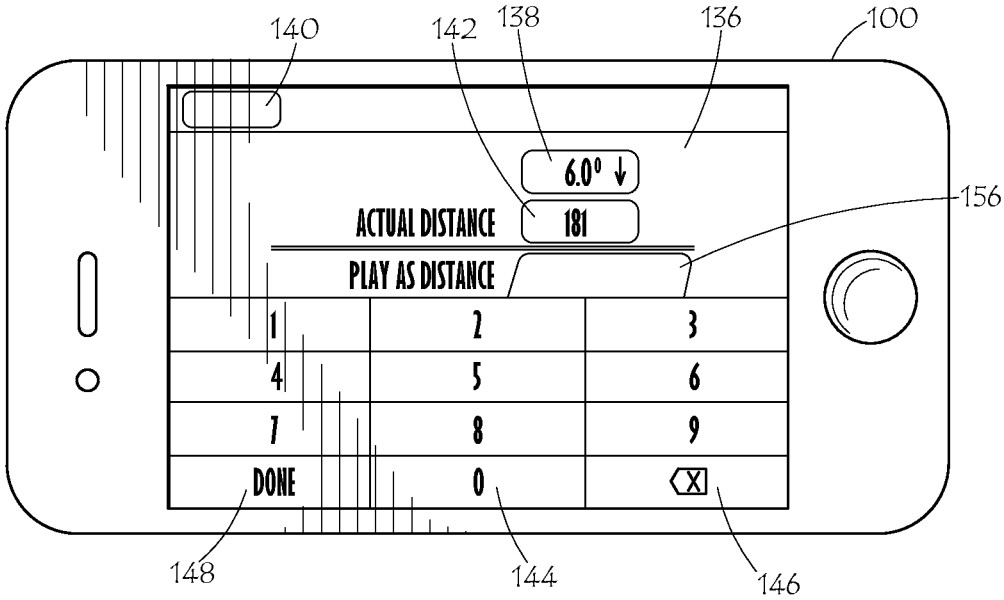
FIG. 11 is another front plan view of the handheld computer of FIG. 7 showing a screen referred to as the Prompt Enter Distance screen which prompts the user to enter the actual distance to the target in accordance with the method of FIG. 6 using the virtual keyboard which appears on the electronic display when this screen is displayed.

The user may now select the Calculate Play As Distance button 116 on FIG. 8 which automatically loads up the Capture screen 126 shown in FIG. 10 (and at 126 in FIG. 6) and accesses the phone's accelerometer or other slope indicating means which is a necessary feature/mechanism of the smart phone or other hand held device 100 of the present invention since it is this feature that enables the device to measure the slope of the terrain. Fortunately, many smart phones manufactured today such as the Apple IPhone 4 possess this feature.

As also shown in FIG. 10, capture screen 126 introduces crosshairs 128 on the phone's screen which serve as a sight for the phone and are used by the golfer to aim the phone at the target which is typically the pin or the pin's flag 129 on the green. The golfer aims the phone by simply aligning the crosshairs 128 with the desired target. As the user aligns the crosshairs 128 with the target 129, the slope of the terrain from the golfer's location to the pin (referred to herein as the ball to pin slope) is indicated to the user in degrees at 130 which as shown in FIG. 10 is in the upper left corner of the device's screen. As mentioned, it is the phone's internal accelerometer which measures the slope.

At this point the user may select the Back button 132 or the Capture button 134. If the user selects the Back button 132 the user is returned to Calculate Play as Distance/Setting screen 112 shown in FIG. 8. If the user selects the Capture button 134, the APP locks in or enters the slope reading currently displayed at 130 in the device's memory and then advances to, i.e. loads up the next screen which is the Prompt Enter Distance screen 136 shown in FIG. 11.

The Prompt Enter Distance screen 136 displays the slope reading from screen 126 that was captured as slope reading 138 and prompts the user to either return to the Calculate Play as Distance/Setting screen 112 using button 140 or enter the actual distance to the target at 142.

The user enters the actual distance using the Numeric Key Pad 144. If the user makes a mistake entering the actual distance the App enables the user to correct the mistake by deleting the incorrect entry with a Delete key 146. In any event, after entering the correct or desired distance at 142 the user saves this distance to the device's memory by selecting the Done key 148 as shown on FIG. 11. If the user happened to enter a distance of less than 50 yards (or 46 meters) or more than 250 yards (or 229 meters), the APP will warn the user that the distance entered is invalid and to re-enter the distance. This warning is indicated at 149 in FIG. 6.

Figure 12:
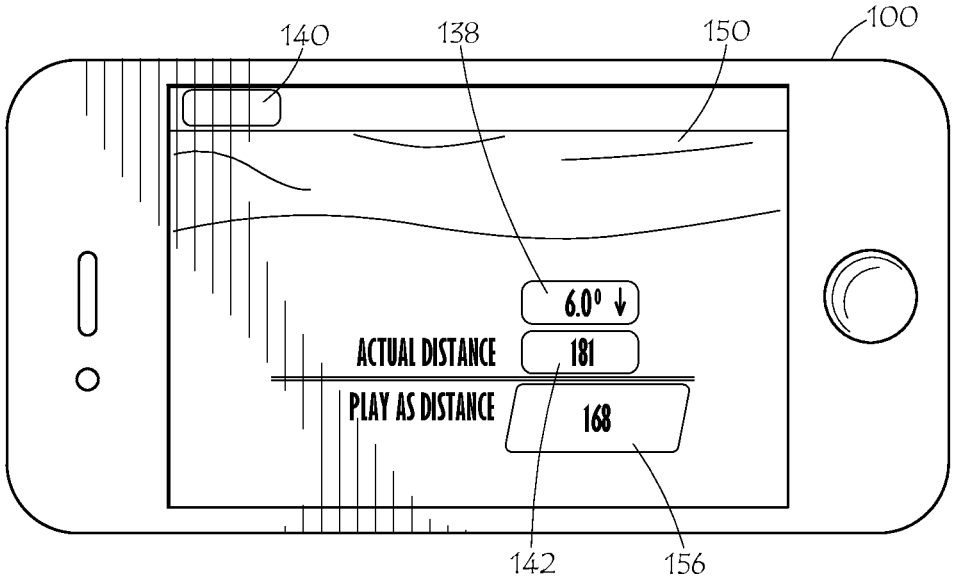
FIG. 12 is another front plan view of the handheld computer of FIG. 7 showing a screen referred to as the Play As Distance screen which automatically appears when the actual distance is entered into memory by pressing the done key of FIG. 11. The screen displays the Play As Distance which is the calculated estimated shot distance to the target as determined by the method of FIG. 6.

Once a valid distance is entered, the Play As Distance screen 150 shown in FIG. 12 will appear. As shown, screen 150 displays the Suggested Play As Distance 156 as well as the previously measured captured slope reading 138 and the actual distance 142 to the target that was inputted by the user on screen 136 of FIG. 11.

At this point the golfer/user will typically select a golf club based on the "play as" distance and make a shot with the selected club in an effort to hit the target with the golf ball. In the alternative, the golfer/user may select button 140 to return to the Calculate Play as Distance/Setting screen 112 and repeat the process.

To carry out the foregoing methodology, the smart phone 100 or other hand held device should preferably have the following features:

1. A rear facing camera to create a live view of the green/pin;
2. A live view screen to accurately target the green/pin; and as mentioned
3. A 3 axis accelerometer to obtain accurate slope readings.

In addition, when the App is downloaded onto the smart phone, a database 160 of yardage correction factors based on slope and distance is likewise downloaded into the smart phone's memory. This database is organized as a set (or matrix) of whole numbers that have been pre-calculated from algorithms based specific ball flight trajectories. When the actual distance is entered by pressing the Done key 148 in FIG. 11, the App accesses database 160 and adjusts the actual distance based upon the captured angle (slope) by adding or subtracting selected whole numbers from the actual distance to calculate and display the suggested "play-as" distance 156 to the golfer. The whole numbers selected by the application will be subtracted from the actual distance for downhill shots and added for uphill shots. Downhill and uphill is determinable by the readings obtained by the internal accelerometer.

As shown in FIG. 6, the App actually carries out a number of internal steps in arriving at the play as distance 156. If the entered distance at 148 is in meters, the distance is adjusted to yards at 162. The entered distance in yards is then rounded down to a 5 yard interval whole number distance at 164. For example, if 144 yards is entered, this distance will be rounded down to 140 yards. If 146 yards is entered, the distance is rounded down to 145 yards. Table database 160 of yardage correction factors is then accessed at 166 and the rounded down distance is adjusted at 168 as discussed above by a factor based upon slope or angle to yield the Play As distance 156 at step 170.

In addition, the application preferably has an auto-sleep down mode which will put the App in a standby or sleep mode if the App has not been used for a short period of time. This will save battery power for the smart phone. The application will remain in sleep mode until the golfer selects it again or turns the application off.

FIGS. 13-17 illustrate another preferred embodiment of the present invention which is similar to that of FIGS. 1-5 in that it also includes a handheld device or estimator 210 for use by golfers to measure the slope of the terrain from a golf ball's location on a golf course to the cup on a green. However, handheld device 210 is more user friendly than handheld device 10 of the embodiment of FIGS. 1-5 since device 210 is provided with a locking button assembly including a button 250 that enables the user to lock in or freeze the slope angle when aiming the device at the target, typically the flag of the pin on the green. The locking button assembly is normally biased in a locked position but when it is pressed it releases display wheel 222 which allows the wheel to rotate as can be visualized by comparing FIGS. 15 and 16. FIG. 15 shows the device in a locked state while FIG. 16 shows button 250 depressed which releases wheel 222. If the device with the button depressed as shown in FIG. 16 is now aimed at the flag (or other desired target) the wheel will rotate to the position which indicates the slope as discussed in connection with the first embodiment of FIGS. 1-5.

Figure 14:
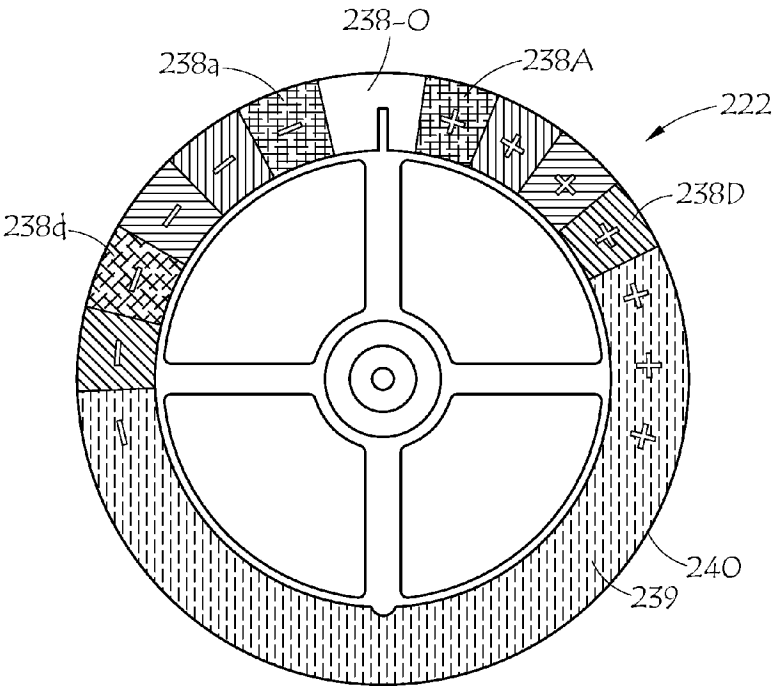
FIG. 14 is a side elevational view showing wheel 222 of FIG. 13 in isolation.

One advantage offered by the new embodiment of FIGS. 13-17 is that button 250 can be released while the device is aimed at the target which as mentioned automatically locks the wheel in the aimed position. Accordingly, unlike the first embodiment the golfer does not have to look into the viewport while he is aiming the device to see the slope indicating color on the display wheel. In the new embodiment, the golfer only needs to aim the device and release button 250 which locks the wheel in the aimed position. The golfer can then look at the viewport or window 242 to see the slope indicating color displayed in the window. The golfer doesn't need to remember the color since will remain locked in window 242 until button 250 is depressed which wouldn't normally occur until it is desired to use the device again. In addition, with the new embodiment the golfer doesn't even need to remember whether the slope is uphill or downhill since the color sections 238 of wheel 222 in the new embodiment as best shown in FIG. 14 are provided with plus and minus signs for respectively indicating uphill and downhill slopes.

It will also be appreciated that window 242 of the new embodiment of FIGS. 13-17 is now located on the same side (side 226) of the device as chart 224. Accordingly, to determine the adjusted distance to the pin after aiming the device at the target and releasing button 250 as indicated above, the golfer only needs to look at the color displayed in window 242 and then look at the square 228 on chart 224 having the same color for the actual "straight line" distance of the shot to get the adjusted distance for the shot.

Figure 13:
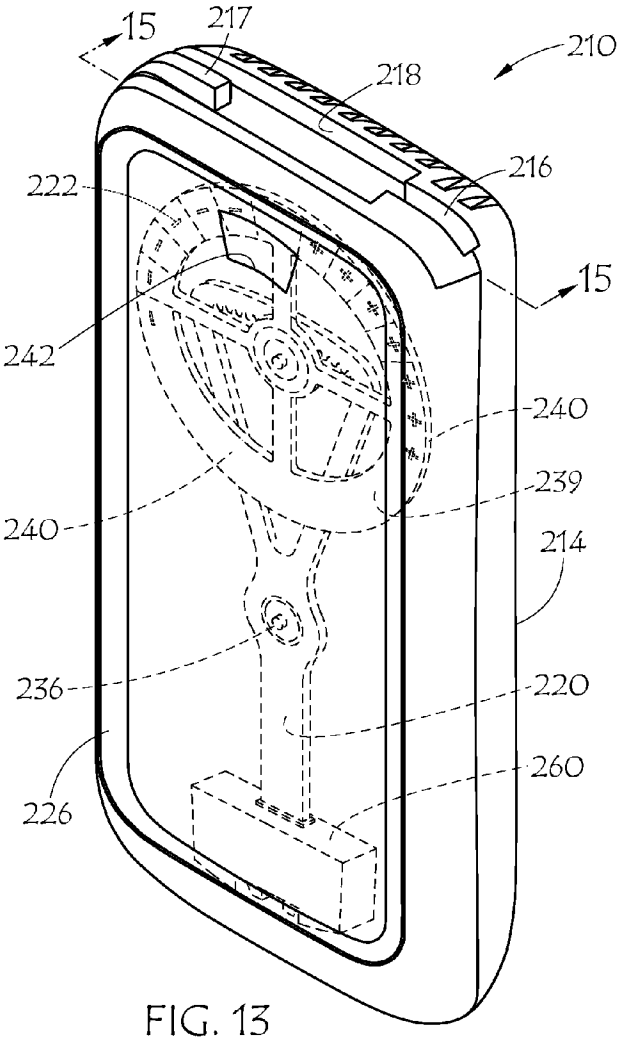
FIG. 13 is a perspective view of another handheld device of the present invention showing the internal components of the device in phantom.

As illustrated in FIGS. 13-17, handheld device or estimator 210 also includes a housing 214 and a sight including a rear sight 216 which as shown in FIG. 13 is channel-shaped and a complementary-shaped front sight groove 217, both of which are formed in the top surface 218 of the housing. In addition, a pendulum tilt sensor 220 is provided for measuring the slope or horizontal angle of the aimed device. Sensor 220 cooperates with display wheel 222 for indicating the slope to the golfer using the device. Chart 224 is affixed to side surface 226 of the housing as indicated above and like chart 24 of the embodiment of FIGS. 1-5 includes actual ball to cup distances (yardage to target), slope indications (colored columns of squares 228) and yardage adjustments in each square 228 from which the effective shot distance of the ball to the cup can be estimated.

Like device 10, device 210 is easily aimed at a target such as flag 13 of pin 15 on the green of a golf course as shown in FIG. 3 by simply aiming the device so that the target appears directly behind rear and front sights 216, 217 when the sights are aligned in a conventional way with front sight 217 positioned in the channel of rear sight 216.

Returning to tilt sensor 220, as indicated above tilt sensor 220 includes a weighted pendulum member 260 at one end and a slightly arcuate gear referred to herein as first gear 221 at its opposite end and as shown in FIGS. 13, 15 and 16, sensor 220 is mounted for rotation about an axle 232 mounted in housing 214. In addition, to prevent the pendulum sensor 220 from over rotation or swinging too far stops 262 are provided in housing 214. As also shown in FIGS. 15 and 16, when pendulum sensor 222 rotates or swings about axle 232 in response to changes in the slope or tilt of the aimed device, its first gear 221 engages a small second gear which is not shown but which is similar to gear 34 of the first embodiment in that it is fixedly attached to display wheel 222 and axially aligned therewith about an axle 236 which is also mounted in housing 214. As will be appreciated, movement or rotation of first gear 221 in response to changes in the slope/tilt of the aimed device causes wheel 222 to rotate as well. The gear ratio between the first gear and the second gear in the embodiment of FIGS. 13-17 is 12:1. As such, display wheel 222 rotates through a much greater axial distance than first gear 221 even more than that of the first embodiment of FIGS. 1-5 which has a gear ratio of 8:1. This high gear ratio allows the printing or affixing of rather large easily viewed colored sections 238A-H along a surface 239 adjacent the outer peripheral edge 240 of the wheel as shown in FIG. 14. These sections are provided with different colors and are also sized and calibrated so that each colored section indicates or corresponds to a different slope or tilt of the aimed device when the colored section is viewed through window 242 as previously discussed. Window 242 like viewport 42 of the first embodiment is sized and positioned in the housing so that a golfer looking into the window will see the color section of the color wheel which corresponds to and thus indicates the slope of the aimed device. Like sections 38 of the first embodiment, section 238A is sized and positioned on the wheel so that when the device is tilted upwardly about 1.25 degrees from a horizontal position, section 238A will appear in window 242. Similarly, when the device is tilted downwardly 1.25 degrees color section 238*a* will appear in the window. Section 238-0 of the color wheel which lies between sections 238A and 238*a* indicates no slope to the green, i.e. 0 degrees. The next sections on the wheel, i.e. 238B and 238*b*, respectively indicate a 2.5 degree uphill and downhill slope. Again, sections 38B and 38*b* preferably share the same color but this color is different than that of 238A and 238*a*. The table set forth above for sections 38 of the first embodiment also sets forth the tilt/slope for each color section 238 of wheel 222 as well as a preferred color for each slope. Chart 224 of FIG. 17 is also similar to chart 24 of the first embodiment and used in the same way to determine distance adjustment for a shot when the actual distance to the pin is known.

As indicated above, device 210 is provided with a locking button assembly including button 250 that enables the user to lock in or freeze the slope angle when aiming the device at a desired target, typically the flag of the pin on the green. The locking button assembly is biased in a locked position but when it is pressed it releases display wheel 222 which allows the wheel to rotate as can be visualized by comparing FIGS. 15 and 16. FIG. 15 shows the device in a locked state while FIG. 16 shows button 250 being depressed which releases wheel 222. As shown in FIG. 15, locking button 250 is biased in the locked position by a coiled spring clip 252 attached to button 250 which has an end 254 that impacts up against wheel 222 to prevent it from rotating. When button 250 is pressed as shown in FIG. 16 the underside of button 250 impacts against a release extension member 256 that is attached to an opposite end 258 of spring clip 252. The pressing of button 250 causes extension member 256 to pivot clip 252 slightly which releases or lifts end 254 up away from the surface of wheel 222, thereby allowing wheel 222 to rotate. Device 210 can now be aimed and when aimed accurately at the target, button 250 can be released to lock wheel 222 in a position which accurately indicates the slope of the aimed target relative to the golfer's location.

Although the invention has been described with reference to the preferred embodiments illustrated in the attached drawing figures, it is noted that equivalents may be employed and substitutions made herein without departing from the scope of the invention as recited in the appended claims. For example, it is specifically contemplated that other types of tilt sensors and inclinometers such as those using a bent glass vial may be substituted for the specific tilt sensor described herein.

I claim:

1. A handheld golf shot distance estimator which measures the slope from a golf ball's location on a golf course to a target desired to be reached by a golfer hitting the golf ball with a golf club, said estimator enabling the golfer to use the measured slope information to estimate the effective shot distance of the ball to the target when the golfer knows the actual distance of the ball to the target, said estimator comprising:

a housing;

a sight mounted on the housing for aiming the estimator at a target;

a tilt sensor including a weighted large diameter first gear mounted in said housing which rotates in response to changes in the slope of the aimed estimator;

a display including a small diameter second gear mounted in said housing which engages said first gear, said display further including a color wheel which is axially aligned with and fixed to said second gear so that rotation of the weighted first gear in response to changes in the slope of the aimed estimator causes said color wheel to rotate, said color wheel being provided with a plurality of colors and calibrated so that each color indicates a specific slope of the aimed estimator, said display further including a viewport/window defined by said housing which is aligned with the color wheel and sized and positioned on the housing so that a golfer looking at the viewport/window can see the color of the color wheel which corresponds to the slope of the aimed estimator; and, a chart affixed to a surface of the housing, said chart including actual ball to target distances, slope indications and distance adjustments from which the effective shot distance of the ball to the target can be estimated.

2. A handheld estimator as claimed in claim 1 wherein the gear ratio between the first gear and the second gear is between about 8:1 and 12:1.

3. A handheld estimator as claimed in claim 1 further comprising a button assembly mounted in said housing for engaging said color wheel to prevent said wheel from rotating, said button assembly releasing said wheel to allow said wheel to rotate when said button is pressed.

4. A handheld estimator as claimed in claim 1 wherein said weighted large diameter first gear includes a weighted pendulum member.

5. A handheld estimator as claimed in claim 1 wherein the colors are provided on or along the outer peripheral edge of the color wheel.

* * * * *